US008135317B2

(12) United States Patent
Uchida

(10) Patent No.: US 8,135,317 B2
(45) Date of Patent: Mar. 13, 2012

(54) DEVELOPMENT DEVICE AND IMAGE FORMING APPARATUS HAVING SAME

(75) Inventor: Shinichi Uchida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 687 days.

(21) Appl. No.: 12/285,630

(22) Filed: Oct. 9, 2008

(65) Prior Publication Data

US 2009/0110446 A1 Apr. 30, 2009

(30) Foreign Application Priority Data

Oct. 25, 2007 (JP) ..... 2007-277715

(51) Int. Cl.
*G03G 15/08* (2006.01)

(52) U.S. Cl. ..... 399/284; 399/274

(58) Field of Classification Search ..... 399/274, 399/284

See application file for complete search history.

(56) References Cited

U.S. PATENT DOCUMENTS

| | | | | |
|---|---|---|---|---|
| 2007/0177906 | A1 | 8/2007 | Yamanaka et al. | |
| 2008/0063438 | A1 * | 3/2008 | Lee | 399/284 |
| 2008/0118280 | A1 * | 5/2008 | Han et al. | 399/284 |

FOREIGN PATENT DOCUMENTS

| | | |
|---|---|---|
| CN | 101013293 A | 8/2007 |
| JP | 7-134485 | 5/1995 |
| JP | 8-179624 | 7/1996 |
| JP | 2004-125924 | 4/2004 |

* cited by examiner

*Primary Examiner* — David Gray
*Assistant Examiner* — Roy Y Yi
(74) *Attorney, Agent, or Firm* — Smith, Gambrell & Russell, LLP

(57) ABSTRACT

A development device 4*a* is separated into a toner agitating portion 21 and a toner supply portion 22 by a boundary wall 23 in which a first opening 28 and a second opening 29 are formed. Inside the toner agitating portion 21, an agitation paddle 24 is rotatably supported, and inside the toner supply portion 22, components such as a development roller 25, a toner supply roller 16, and a regulation member 27 made of metal for regulating the thickness of a thin toner layer formed on the development roller 25 and for electrically charging toner are provided. A groove 27*a* is formed in the regulation member 27 all along the length thereof.

12 Claims, 5 Drawing Sheets

DEVELOPMENT DEVICE AND IMAGE FORMING APPARATUS HAVING SAME

This application is based on Japanese Patent Application No. 2007-277715 filed on Oct. 25, 2007.

BACKGROUND OF THE INVENTION

1. Field of the Invention

The present invention relates to a development device for use in image forming apparatuses such as copiers, printers, and facsimile machines that employ an electro-photographic process, and in particular to a development device that uses a single-component developer, and an image forming apparatus provided therewith.

2. Description of Related Art

Two types of development devices are known to be used in image forming apparatuses employing an electro-photographic process such as copiers, printers, facsimile machines, and multifunction peripherals having these functions; that is, a two-component development device that uses a developer containing a toner and a carrier, and a single-component development device that uses a developer containing only a toner but no carrier.

In a non-magnetic single-component development device, a toner stored in the device main body is fed to the surface of a development roller by a supply roller, and then a regulation member is pressed against this development roller to regulate the amount of toner and to triboelectrically charge the toner, and thereby a thin toner layer is formed. Then, the development roller is rotated so as to lead the toner to a development area that faces an image carrier to develop an electrostatic latent image formed on the image carrier. The toner remaining on the surface of the development roller is removed from the surface of the development roller by the supply roller, and fresh toner is supplied to the development roller. This system is advantageous in providing a low-cost image forming apparatus.

In non-magnetic development, a thin metal plate having elasticity (spring member) is typically used as a regulation member, which is flat-plate shaped in many cases. However, since the regulation member is designed to be pressed against a development roller with a slight pressure, the thin metal plate may, for example, become wavy (i.e., may warp) to degrade the flatness of the regulation member in its length direction (the direction of the length of the development roller). This inconveniently prevents the regulation member from being uniformly pressed against the development roller, causing uneven thickness of the thin toner layer, which results in uneven density of a formed image.

To solve the problem described above, for example, JP-A-H07-134485 and JP-A-H08-179624 disclose a development device where an elastic blade an end of which is bent in a direction opposite to a development roller is used as a regulation member. Also, JP-A-2004-125924 discloses a development unit having a detachable pressure dispersion member formed of a material such as urethane foam provided for dispersing pressure from the regulation member between the regulation member and the development roller.

However, with the method of JP-A-H07-134485 and JP-A-H08-179624, although it is possible to prevent the waving of the regulation member occurring near a portion thereof at which it is in contact with the development roller, since the regulation member needs to be bent at an end thereof, the contact between the regulation member and a seal member disposed to cover an end of the regulation member at the both ends of the development roller is weakened, and thus it is difficult to prevent the regulation member from warping along with maintaining the toner sealability of the development roller. The method is also inconvenient in that toner tends to be accumulated in the bent portion of the end of the regulation member. On the other hand, with the method of JP-A-2004-125924, although it is possible to prevent deformation of the regulation member attributable to factors such as the length of time from the shipping of a product until the user starts to use the product, shock and impact the product suffers during the time, and the temperature and humidity of the environment in which the product is placed during the time, the method gives no consideration to preventing deformation of the regulation member after the product starts to be used.

SUMMARY OF THE INVENTION

In view of the above problems, an object of the present invention is to provide a single-component development type development device capable of preventing a regulation member from waving with a simple structure and thereby capable of forming a uniformly thick thin toner layer, and an image forming apparatus provided therewith.

To achieve the above object, according to one aspect of the present invention, a development device using a single-component developer includes: a case for storing a toner therein; a toner carrier for carrying the toner stored in the case; and a regulation member that is pressed against the toner carrier so as to regulate a thickness of a toner layer formed on the toner carrier. Here, a groove is continuously formed substantially all along a length of the regulation member so as to be substantially parallel to a direction of the length thereof.

With this structure, since the groove serves as a rib that prevents the regulation member from warping in its length direction, the flatness of the regulation member is improved. As a result, a load is uniformly applied onto the surface of the toner carrier when the regulation member is brought into contact with the toner carrier with a slight pressure, and this makes it possible to form a thin toner layer having a uniform thickness in the longitudinal direction of the toner carrier. In addition, it is possible to dispose a seal member so as to be in close contact with an end of the regulation member so as to prevent toner leakage at both ends of the toner carrier.

According to the present invention, it is preferable that the groove be formed such that it is concave toward the toner carrier.

With this structure, it is possible to prevent the toner from being accumulated in the groove and to prevent the groove and the toner carrier from interfering with each other.

According to the present invention, it is preferable that the groove be V-shaped in section.

With this structure, since excess toner regulated by the regulation member easily moves along the ridge line of the V-shape of the regulation member, it is possible to more effectively prevent the toner from accumulating in the vicinity of the groove.

According to the present invention, it is preferable that the groove be formed substantially in a center of the regulation member in a direction perpendicular to its length direction.

With this structure, it is possible to maintain the balance between an effect of preventing the warp of the regulation member and an effect of uniformizing the thickness of a thin toner layer.

According to another aspect of the present invention, an image forming apparatus incorporates the development device structured as described above.

With this structure, the image forming apparatus is free from uneven density of a formed image and toner leakage over a long period of time.

DETAILED DESCRIPTION OF PREFERRED EMBODIMENTS

Figure 1:
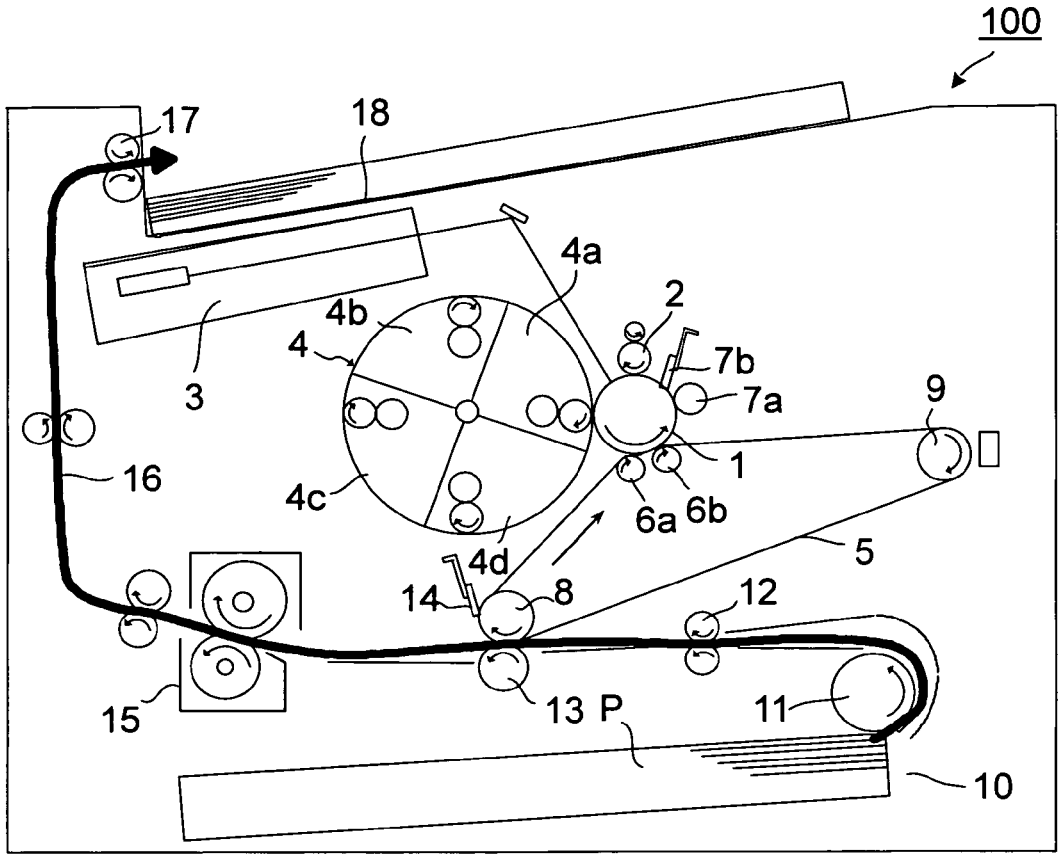
FIG. 1 is a side sectional view showing a rotary-type color image forming apparatus incorporating a development device of the present invention.

A description will be given below of an embodiment of the present invention with reference to the drawings. FIG. 1 is a diagram schematically showing the structure of a color image forming apparatus of rotary development type incorporating a development device of the present invention. In a copying operation of an image forming apparatus (here, a color printer) 100, a photoconductive drum 1 that rotates counterclockwise in the figure is uniformly charged by a charging unit 2 inside the main body of the apparatus. Then, a laser beam is applied onto the surface of the photoconductive drum 1 from an exposing unit 3 according to image data of a manuscript inputted to an image input section (not shown) from a personal computer or the like, and thereby an electrostatic latent image is formed on the surface of the photoconductive drum 1.

The photoconductive drum 1 is formed by, for example, laminating a photoconductive layer on an aluminum drum, and its surface is electrically charged by the charging unit 2. And, on the surface of the photoconductive drum 1 onto which the laser beam is applied from the exposing unit 3, an electrostatic latent image is formed in which electric charge is reduced. A material such as an amorphous silicon photoconductor and an organic photoconductor (OPC) is used to form the photoconductive layer. In the case where a positive OPC is used as the photoconductive layer, only a small amount of ozone and the like is generated, and thus stable charging is achieved; in particular, a single-layer positive OPC is preferably used to achieve a long-life system, because, even if the thickness of the layer changes after a long use, the photoconductive properties of the single-layer positive OPC do not change significantly, and thus the image quality is kept stable.

Reference numeral 4 denotes a rotary-type development unit that supplies toner onto the photoconductive drum 1. The development unit 4 includes development devices 4*a*, 4*b*, 4*c*, and 4*d* for yellow, magenta, cyan, and black, respectively, each of which is a cartridge in which a development part and a toner container are integrally included; the development unit 4 rotates to bring the development devices 4*a* to 4*d* to a position facing the photoconductive drum 1 one after another such that positive toners of respective colors are adhered onto the electrostatic lateral image formed on the photoconductive drum 1, and thereby toner images of the respective colors are formed.

Reference numeral 5 denotes an intermediate transfer belt onto which a toner image is transferred, and the intermediate transfer belt 5 is arranged between intermediate transfer rollers 6*a* and 6*b*, a belt driving roller 8, and a driven roller 9, and made to rotate clockwise in the figure by unillustrated driving means while it is kept in contact with the photoconductive drum 1. The intermediate transfer belt 5 is formed of a dielectric resin sheet and is formed as an endless belt by superimposing both ends of the dielectric resin sheet on each other to join them together or as an endless belt without a seam (seamless belt).

When the user inputs an instruction to start an image forming operation, a yellow toner image is formed on the photoconductive drum 1 at a predetermined timing. Then, the yellow toner image formed on the photoconductive drum 1 is transferred onto the intermediate transfer belt 5 by the intermediate transfer rollers 6*a* and 6*b* to which a negative transfer bias is applied (primary transfer). Thereafter, residual toner remaining on the surface of the photoconductive drum 1 is removed by a cleaning roller 7*a* and a cleaning blade 7*b*, and then the development unit 4 rotates by a predetermined angle (here, 90 degrees) so that a magenta toner image is formed on the photoconductive drum 1 and transferred onto the intermediate transfer belt 5 in the same manner as described above.

Subsequently, in the same manner as described above, cyan and black toner images are transferred onto the intermediate transfer belt 5 from the photoconductive drum 1. These images of the four colors are formed in a predetermined positional relationship with respect to one another to form a predetermined full color image. Reference numeral 13 denotes a transfer roller located under the intermediate transfer belt 5, and reference numeral 14 denotes a belt cleaning blade that removes residual toner remaining on the surface of the intermediate transfer belt 5.

Toward the intermediate transfer belt 5 on which a toner image is formed as described above, a sheet of paper P is transported from a paper feeding mechanism 10 via a paper feeding roller 11 and a resist roller pair 12. Then, the full color toner image formed by sequentially transferring each color toner image onto the surface of the intermediate transfer belt 5 is transferred onto the sheet of paper P at one time by the transfer roller 13 to which a negative transfer bias is applied (secondary transfer). The sheet of paper P on which the toner image is transferred is transported to a fixing device 15, where the toner image is fixed. The sheet of paper P, after passing through the fixing device 15, is ejected onto an ejection tray 18 via a paper transport path 16 and a sheet ejection roller pair 17.

Figure 2:
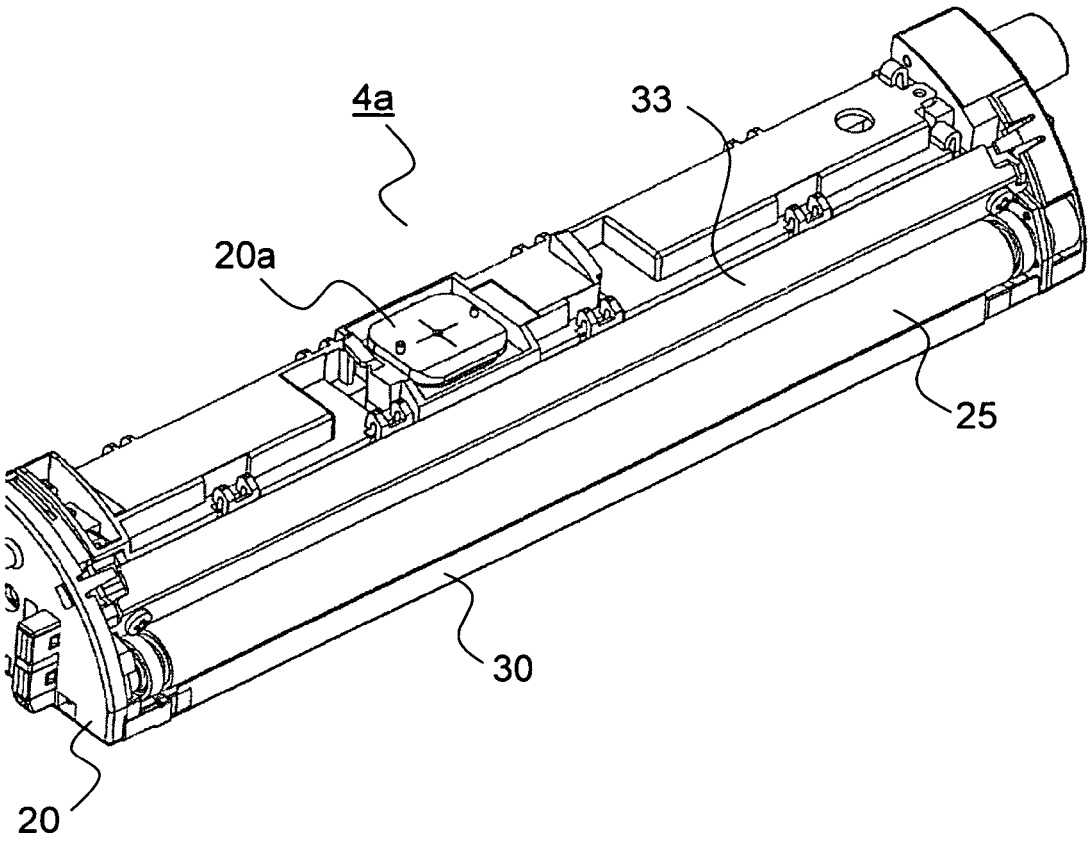
FIG. 2 is a perspective view showing the development device of the present invention as seen from a development roller side.
Figure 3:
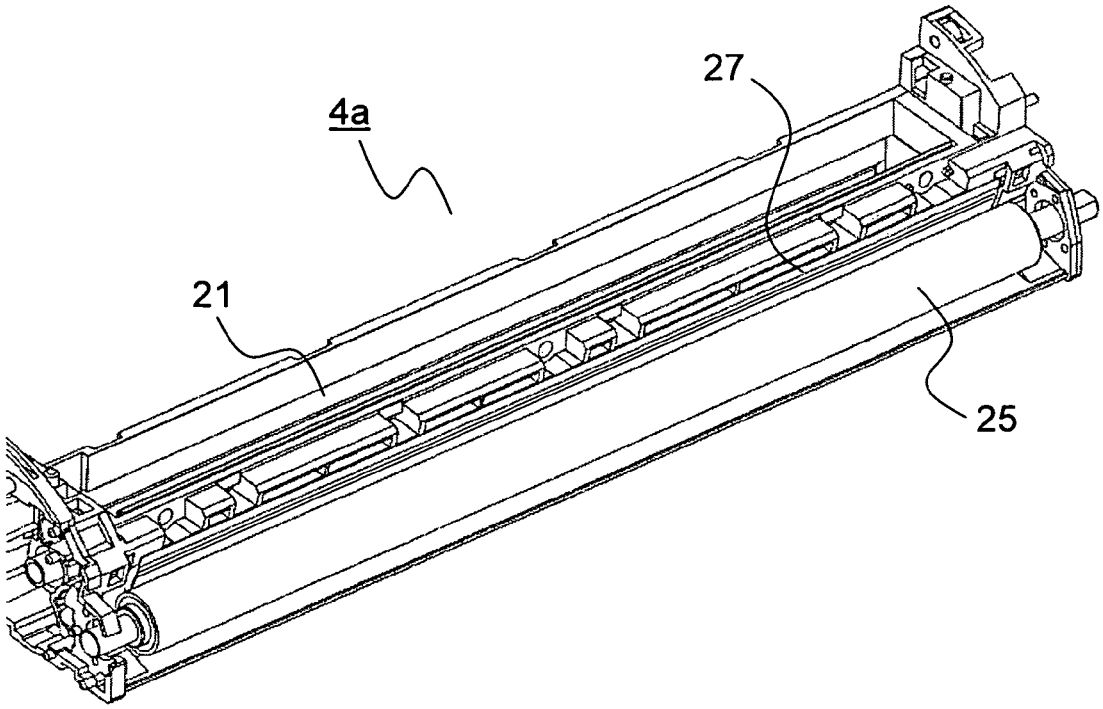
FIG. 3 is a perspective view showing a regulation member exposed from the state shown in FIG. 2.
Figure 4:
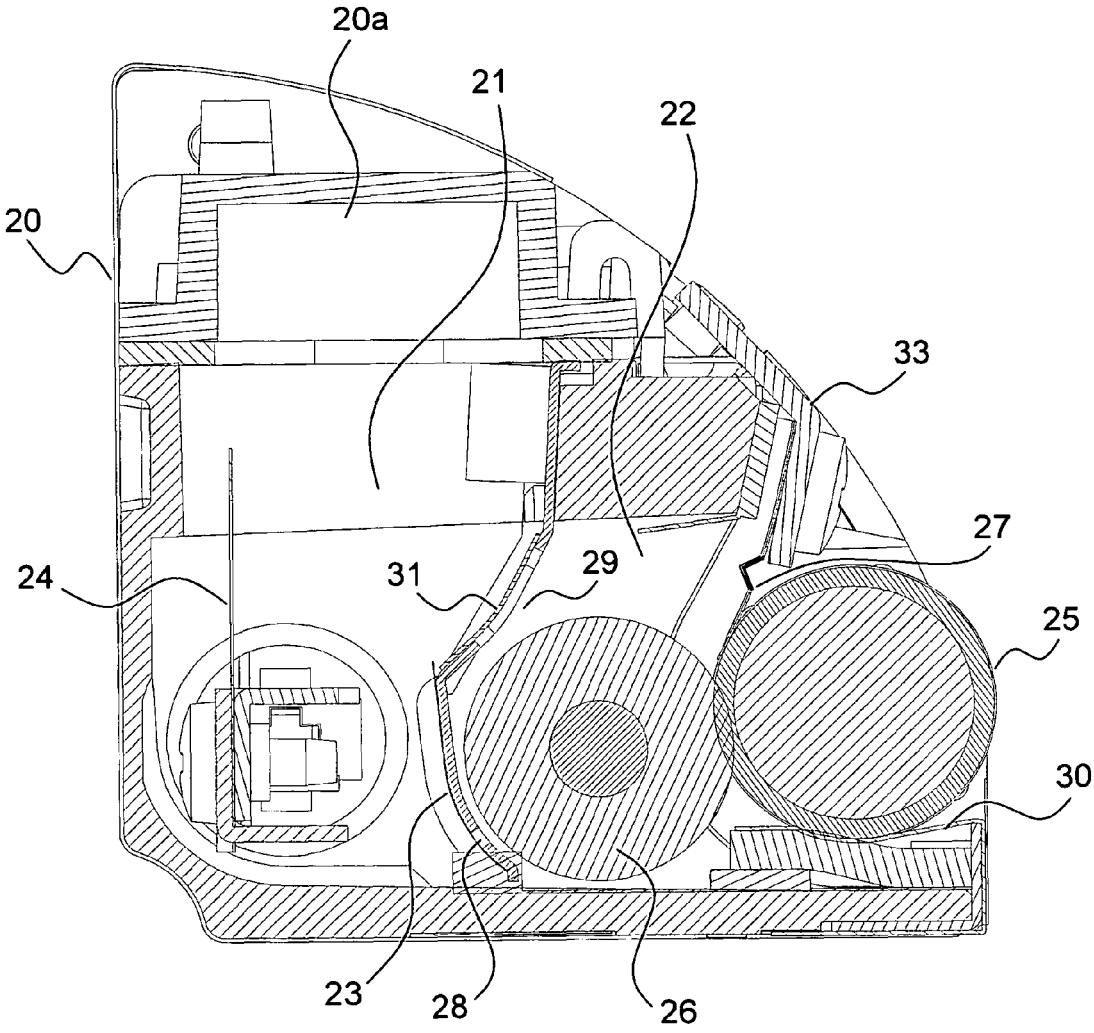
FIG. 4 is a side sectional view showing the development device of the present invention.

FIG. 2 is a perspective view showing the development device of the present invention as seen from the development roller side, FIG. 3 is a perspective view showing a regulation member exposed from the state shown in FIG. 2, and FIG. 4 is a side sectional view showing the development device. Descriptions will be given below of the structure and the operation of the development device 4*a* that faces the photoconductive drum 1 as shown in FIG. 1; however, descriptions of the structures and the operations of the development devices 4*b* to 4*d* will be omitted, because they are structured and operate basically in the same manner as the development device 4*a*.

The development device 4*a* includes, inside a development container 20 made of resin, a toner agitating portion 21 in which toner supplied via a toner supply port 20*a* is stored and a toner supply portion 22 to which toner is supplied from the toner agitating portion 21. The toner agitating portion 21 and the toner supply portion 22 are separated by a boundary wall 23. In the boundary wall 23, a first opening 28 and a second opening 29 are formed, the second opening 29 being located above the first opening 28 in the figure. To a face of the boundary wall that is located in the toner agitating portion 21 is fitted an opening/closing member 31 that opens/closes the second opening 29 to control the amount of toner charged into the toner supply portion 22.

In the toner agitating portion 21, an agitation paddle 24 formed by attaching to a rotation shaft an agitation blade made of, for example, a PET film is supported to be rotatable counter-clockwise in FIG. 2. In the toner support portion 22, there are provided components such as a development roller 25 that faces the photoconductive drum 1 (see FIG. 1) carrying a latent image thereon and develops the latent image, a toner supply roller 26 for supplying toner to the development roller 25, a regulation member 27 made of metal for regulating the thickness of a toner layer formed on the development roller 25 and for electrically charging the toner.

The toner layer formed on the development roller 25 has its thickness regulated and is also triboelectrically charged by the regulation member 27 (which is formed of, for example, a 0.008 mm thick SUS plate, and whose regulation pressure is set to 25 N/m), and is used to develop an electrostatic latent image formed on the photoconductive drum 1. The regulation member 27 is fixed to the development container 20 via a regulation member fixing stay 33.

In a gap between the development roller 25 and the development container 20, the gap being located opposite to the regulation member 27 with respect to the development roller 25, a seal member 30 (which is, for example, a conductive high molecular weight PE film backed-up by a polyurethane sponge to be in uniform contact with the development roller 25) is disposed so as to prevent toner leakage. The seal member 30 lies not only under the development roller 25 as shown in FIG. 4 but also reaches the both ends of the development roller 25 so as to be in contact with an end of the regulation member 27, and this prevents toner from leaking from around the bearings of the development roller 25.

Furthermore, the development roller 25 and the toner supply roller 26 rotate clockwise in FIG. 2, and hence the second opening 29 is formed on the downstream side of the first opening 28 in the rotation direction of the toner supply roller 26 and above the toner supply roller 26. And the first opening 28 is positioned below the rotation shaft of the agitation paddle 24.

Next, a description will be given of a development process performed by the development device of the present invention. Toner is supplied from the toner container (not shown) via the toner supply port 20*a* to the toner agitating portion 21 to be stored therein; the toner stored in the toner agitating portion 21 is sent by the rotation of the agitation paddle 24 through the first opening 28 to the toner supply portion 22. The toner sent to the toner supply portion 22 is transported by the toner supply roller 26 to the development roller 25, where the toner is formed into a layer whose thickness is regulated by the regulation member 27, and is then transported to a development nip to develop the electrostatic latent image formed on the photoconductive drum 1. Toner remaining on the development roller 25 without being used for the development passes over the seal member 30 and is then transported back to the toner supply portion 22.

Excess part of the toner transported by the toner supply roller 26 that is regulated by the regulation member 27 is accumulated in the toner supply portion 22 with toner newly supplied (charged) through the first opening 28; however, when the amount of toner in the toner supply portion 22 increases, excess toner is sent from the toner supply portion 22 side back to the toner agitating portion 21 via the second opening 29, and thereby the inner pressure of the toner supply portion 22 is reduced.

Also, since the opening/closing member 31 is provided so as to suppress toner circulation between the toner agitating portion 21 and the toner supply portion 22, toner sorting (i.e., preferential consumption of toner particles having a small particle diameter) can be suppressed, and thus poor image formation can be prevented. Furthermore, since the opening/closing member 31 is located on the toner agitating portion 21 side, there is no need of providing a gap between the toner supply roller 26 and the opening/closing member 31, and moreover, since toner is charged into the toner supply portion 22 via the first opening 28, the development device itself can be made smaller and free from poor image formation over a long period of time.

The opening/closing member 31 opens/closes the second opening 29 according to the amount of toner stored in the toner supply portion 22, and thereby toner is allowed to pass through the second opening 29 only from the toner supply portion 22 side to the toner agitating portion 21 side. Thus, the toner supply portion 22 is prevented from being charged with too much toner, and this helps prevent poor circulation of toner occurring in the toner supply portion 22 due to charging the toner supply portion 22 with too much toner. That is, since toner is not accumulated in the toner supply portion 22, no large rotation load is imposed on the toner supply roller 26, and as a result, toner can be stably supplied to the development roller 25; and furthermore, since toner is always properly electrically charged, poor image quality such as fog can be prevented.

Figure 5:
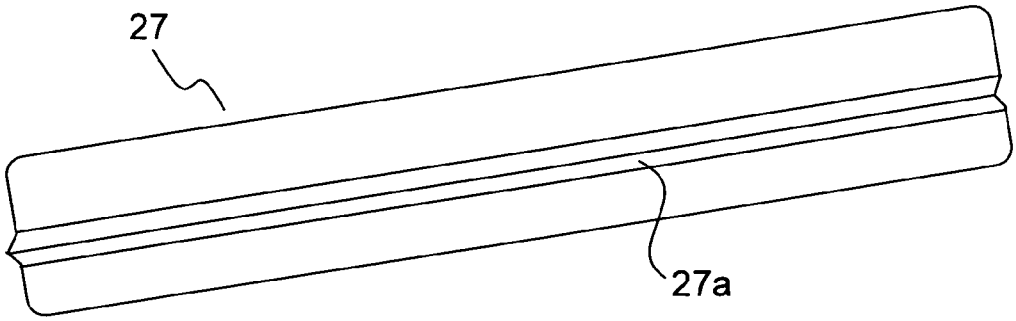
FIG. 5 is a perspective view showing the regulation member used in the development device of the present invention.
Figure 6:
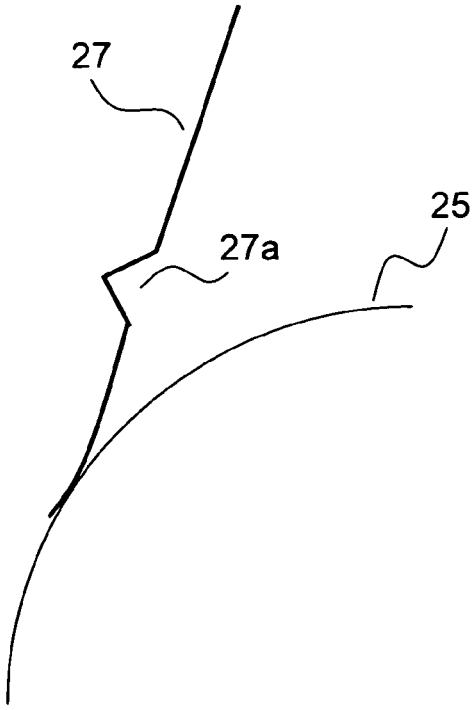
FIG. 6 is an enlarged view showing the regulation member when it is in contact with the development roller as seen from a side.

FIG. 5 is a perspective view showing the regulation member used in the development device of the present invention, and FIG. 6 is an enlarged view showing the regulation member when it is in contact with the development roller as seen from a side. As shown in FIG. 5, a groove 27*a* that is V-shaped in section is continuously formed all along the length of the regulation member 27. The groove 27*a* may be formed, for example, by folding or by pressing with a metal mold the regulation member 27 made of sheet metal.

With this structure, the groove 27*a* serves as a rib that prevents the regulation member 27 from warping in its length direction, and thus the flatness of the regulation member 27 is improved. As a result, a load is uniformly applied onto the surface of the development roller 25 when the regulation member 27 is brought into contact with the development roller 25 with a slight pressure as shown in FIG. 6, and this makes it possible to form a thin toner layer having a uniform thickness in the longitudinal direction of the development roller 25. In particular, since a thin toner layer having a stable thickness can be obtained even in the case where the amount of projection toward the development roller 25 (i.e., the length of the regulation member 27 in its width direction) is not ample, this structure can be advantageously used in a compact development device such as the development devices 4*a* to 4*d* used in a rotary printer as shown in FIG. 1.

Also, since the end of the regulation member 27 is not bent, the seal member 30 that prevents toner leakage at the both ends of the development roller 25 can be disposed so as to be in close contact with the end of the regulation member 27. As a result, with the development device 4*a* of the present invention, it is possible to achieve both the forming of a thin toner layer having a uniform thickness in the longitudinal direction of the development roller 25 and the maintaining of the toner sealability at the both ends of the development roller 25, and thus, in the image forming apparatus 100 shown in FIG. 1 that incorporates the development device of the present invention, inconveniences such as uneven density of a formed image attributable to uneven thickness of a thin toner layer and toner leakage occurring around the bearings of the development roller 25 can be effectively prevented.

Incidentally, although the groove 27*a* is formed such that it is concave toward the development roller 25 when it is attached to the development container 20 in this embodiment, the groove 27*a* can be formed such that it is convex toward the development roller 25. However, in the case where the groove 27*a* is formed such that it is convex toward the development roller 25, toner is liable to be accumulated in the groove 27*a*, and depending on the position where the groove 27*a* is formed, the groove 27*a* and the development roller 25 may interfere with each other. Therefore, it is preferable that the groove 27*a* be formed such that it is concave toward the development roller 25 as in this embodiment. Furthermore, the groove 27*a* in this embodiment that is V-shaped in section allows excess toner regulated by the regulation member 27 to easily move along the ridge line of the groove 27*a*, and this makes it possible to more effectively prevent toner from being accumulated around the groove 27*a*.

In the case where the groove 27*a* is formed in the vicinity of a portion at which the regulation member 27 is in contact with the development roller 25, flatness of the end of the regulation member 27 is degraded, which may cause unevenness in the thickness of a thin toner layer. On the other hand, in the case where the groove 27*a* is formed in the vicinity of the regulation member fixing stay 33 (see FIG. 4), it is less effective in preventing the regulation member 27 from warping. Therefore, in view of obtaining in a balanced manner an effect of preventing the regulation member 27 from warping and an effect of uniformizing the thickness of the thin toner layer, it is preferable that the groove 27*a* be formed substantially in the center of the regulation member 27 in its width direction (a direction perpendicular to its length direction) as shown in FIG. 5.

Also, the groove 27*a* does not necessarily need to be formed all along the length of the regulation member 27; when the groove 27*a* is formed substantially all along the length of the regulation member 27, the groove 27*a* can be expected to be effective in preventing the regulation member 27 from warping. Therefore, the groove 27*a* may be formed, for example, such that a portion at an end or at either end of the regulation member 27 is left flat.

The present invention is not limited to the embodiments described above, but various modifications may be made within the scope and spirit of the present invention. For example, the cross-sectional shape of the groove 27*a* is not limited to a V-shape, but the groove 27*a* maybe U-shaped or square U-shaped in section. Also, application of the present invention is not limited to a rotary-type color printer as shown in FIG. 1, but the present invention can be applied to image forming apparatuses incorporating a single-component development type development device, such as a digital and an analog monochrome copier, a digital and an analog color copier, and a facsimile machine.

The present invention is a development device using a single-component developer that is provided with: a case for storing a toner therein; a toner carrier for carrying the toner stored in the case; and a regulation member in which a groove is continuously formed substantially all along the length thereof so as to be substantially parallel to the direction of the length thereof, and that is pressed against the toner carrier so as to regulate the thickness of a toner layer formed on the toner carrier.

Thus can be provided in a simple and low-cost manner a development device that can achieve both uniform thickness of a thin toner layer in the longitudinal direction of a toner carrier and toner sealability at both ends of the toner carrier.

Also, a development device having a regulation member that is superior in flatness makes it possible to provide an image forming apparatus free from a failure in image formation such as an uneven density of a formed image and toner leakage over a long period of time.

What is claimed is:

1. A development device using a single-component developer, comprising:

a case for storing toner therein;

a toner carrier for carrying the toner stored in the case; and a regulation member in which a groove is continuously formed substantially all along a length thereof so as to be substantially parallel to a direction of the length thereof, and that is pressed against the toner carrier so as to regulate a thickness of a toner layer formed on the toner carrier, wherein, the regulation member includes a pair of mutually-parallel flat portions which are formed on both sides of the groove so as to be continuous with each other with different fold lines in between in a direction perpendicular to the direction of the length of the regulation member; and the groove is concave toward the toner carrier.

2. The development device of claim 1, wherein the flat portions located on both sides of the groove are formed substantially on the same plane.

3. The development device of claim 2, wherein the groove is V-shaped in section.

4. The development device of claim 1, wherein the groove is formed substantially in a center of the regulation member in a direction perpendicular to the direction of the length of the regulation member.

5. The development device of claim 2, wherein the groove is formed substantially in a center of the regulation member in a direction perpendicular to the direction of the length of the regulation member.

6. The development device of claim 3, wherein the groove is formed substantially in a center of the regulation member in a direction perpendicular to the direction of the length of the regulation member.

7. An image forming apparatus, comprising the development device of claim 1.

8. An image forming apparatus, comprising the development device of claim 2.

9. An image forming apparatus, comprising the development device of claim 3.

10. An image forming apparatus, comprising the development device of claim 4.

11. An image forming apparatus, comprising the development device of claim 5.

12. An image forming apparatus, comprising the development device of claim claim 6.

* * * * *